US005999770A

United States Patent [19]

Li

[11] Patent Number: 5,999,770

[45] Date of Patent: Dec. 7, 1999

[54] DEVELOPER CONTAINER WITH SLIDING COVER MEANS

[75] Inventor: Kuan-Tung Li, Wu-Chi, Taiwan

[73] Assignee: General Plastic Industrial Co., Ltd., Taichung, Taiwan

[21] Appl. No.: 09/305,981

[22] Filed: May 5, 1999

[51] Int. Cl.[6] ..... G03G 15/06

[52] U.S. Cl. ..... 399/106; 141/364; 220/258; 222/DIG. 1

[58] Field of Search ..... 399/106, 105, 399/103, 102; 141/363, 364; 206/467, 816, 216; 220/258; 222/DIG. 1, 167

[56] References Cited

U.S. PATENT DOCUMENTS

| | | | |
|---|---|---|---|
| 4,062,385 | 12/1977 | Katusha et al. | 141/364 X |
| 4,650,070 | 3/1987 | Oka et al. | 222/DIG. 1 X |
| 4,834,246 | 5/1989 | Inoue et al. | 220/258 X |
| 5,175,588 | 12/1992 | Katagata | 399/106 |
| 5,263,517 | 11/1993 | Ishikawa et al. | 399/106 X |
| 5,351,728 | 10/1994 | Ban et al. | 141/364 |
| 5,363,177 | 11/1994 | Nakano et al. | 399/106 |

FOREIGN PATENT DOCUMENTS

| | | |
|---|---|---|
| 04-346377 | 12/1992 | Japan . |
| 04-369668 | 12/1992 | Japan . |

*Primary Examiner*—William Royer
*Assistant Examiner*—Sophia S. Chen
*Attorney, Agent, or Firm*—Pro-Techtor International Services

[57] ABSTRACT

A developer container, which includes a container body having a bottom developer supply hole and two longitudinal sliding grooves at two opposite sides of the bottom developer supply hole, a sliding cover moved with a carrier in and out of the sliding grooves at the container body, and a sealing membrane moved with the sliding cover to close/open the bottom developer supply hole.

1 Claim, 5 Drawing Sheets

DEVELOPER CONTAINER WITH SLIDING COVER MEANS

BACKGROUND OF THE INVENTION

The present invention relates to a developer container for use with a developer replenishing device in a copier, facsimile apparatus, printer or similar electrophotographic image forming apparatus, and more particularly to such a developer container which has bottom sliding cover means for covering its bottom developer supply hole.

FIG. 1 shows a developer container constructed according to U.S. Pat. Des.404.063 for use with a developer replenishing device in a copier, facsimile apparatus, printer or similar electrophotographic image forming apparatus. This structure of developer container comprises a container body A, a sliding cover B at the bottom side of the container body A, a sheet-like sealing member C moved in and out of the sliding cover B, and a pull handle D at an outer end of the sheet-like sealing member C. The sealing member C has a part adhered to the bottom side wall of the container body A. When installed in an electrophotographic image forming apparatus, the pull handle D is pulled outwards, enabling the sealing member C and the sliding cover B to be pulled out of the bottom side wall of the container body A, and therefore the bottom developer supply hole at the bottom side of the container body A is opened to let developer be supplied out of the container body A. This structure of developer container is not satisfactory in function because a spacious operation space must be provided inside the electrophotographic image forming apparatus, so that the sealing member C and the sliding cover B can be fully extended out for letting developer be supplied out of the container body A through the bottom developer supply hole at the bottom side of the container body A.

SUMMARY OF THE INVENTION

The present invention has been accomplished to provide a developer container which eliminates the aforesaid problem. It is the main object of the present invention to provide a developer container which requires less installation space. According to one aspect of the present invention, the developer container comprises a container body having a bottom developer supply hole and two longitudinal sliding grooves at two opposite sides of the bottom developer supply hole, a sliding cover moved with a carrier in and out of the sliding grooves at the container body, and a sealing membrane moved with the sliding cover to close/open the bottom developer supply hole. According to another aspect of the present invention, the carrier has a hinged handhold that can be secured in a collapsed manner to reduce space occupation.

DETAILED DESCRIPTION OF THE PREFERRED EMBODIMENT

Figure 1:
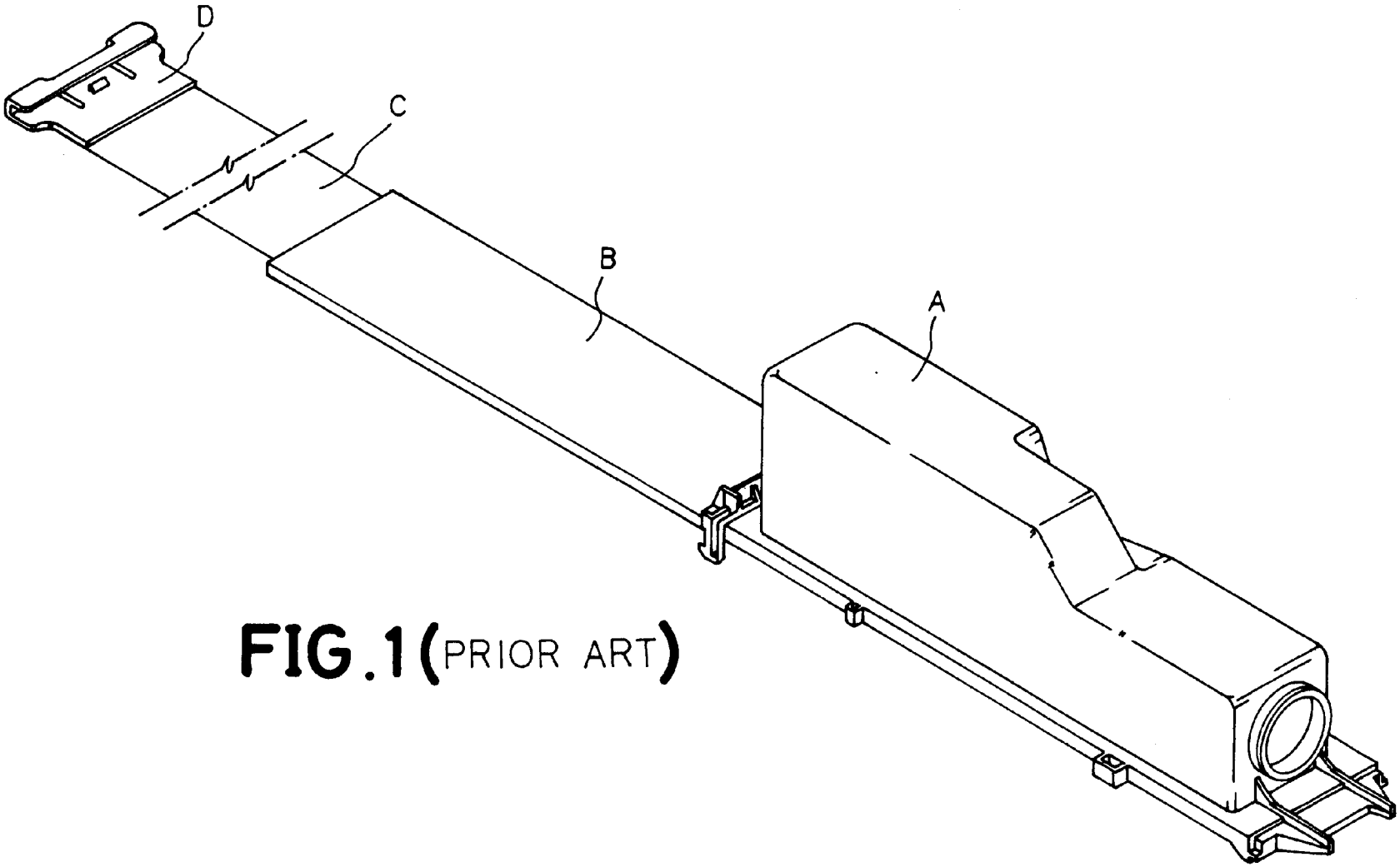
FIG. 1 (PRIOR ART)
FIG. 1 is a perspective view of a developer container with a sliding cover according to the prior art.
Figure 2:
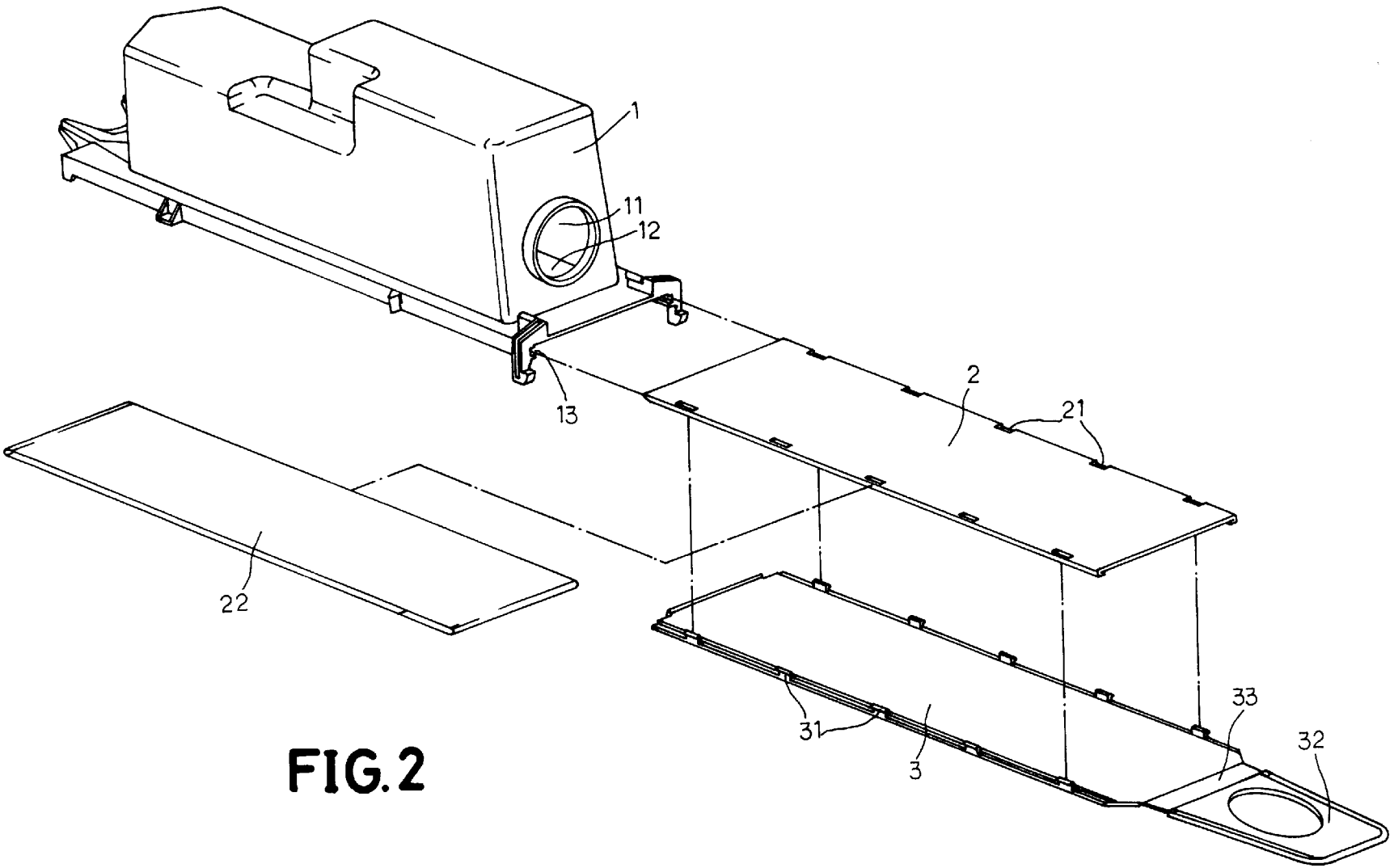
FIG. 2 is an exploded view of a developer container with a sliding cover according to the present invention.

Referring to FIGS. 1 and 2, a developer container is shown comprised of a container body 1, a sliding cover 2, and a carrier 3. The container body 1 is a stepped, rectangular box having a developer storage chamber 11, a bottom developer supply hole 12 at the bottom side thereof through which developer is supplied out of the developer storage chamber 11, and two sliding grooves 13 longitudinally disposed at two opposite sides of the bottom developer supply hole 12. The sliding cover 2 is inserted into the sliding grooves 13 at the bottom side of the container body 1 to close the bottom developer supply hole 12, having a plurality of retaining holes 21 symmetrically disposed at two opposite lateral sides thereof. Further, a sealing membrane 22 is attached to the top side wall of the sliding cover 2 at the top, having one end fixedly adhered to the bottom side wall 14 of the body 1 at the front side of the bottom developer supply hole 12, and an opposite end fixedly adhered to the sliding cover 2. The carrier 3 is a flat, sheet-like member having a plurality of hooks 31 symmetrically provided at two opposite lateral sides thereof and respectively hooked in the retaining holes 21 at the sliding cover 2, a flat handhold 32 connected its front end by a hinge 33.

Figure 3:
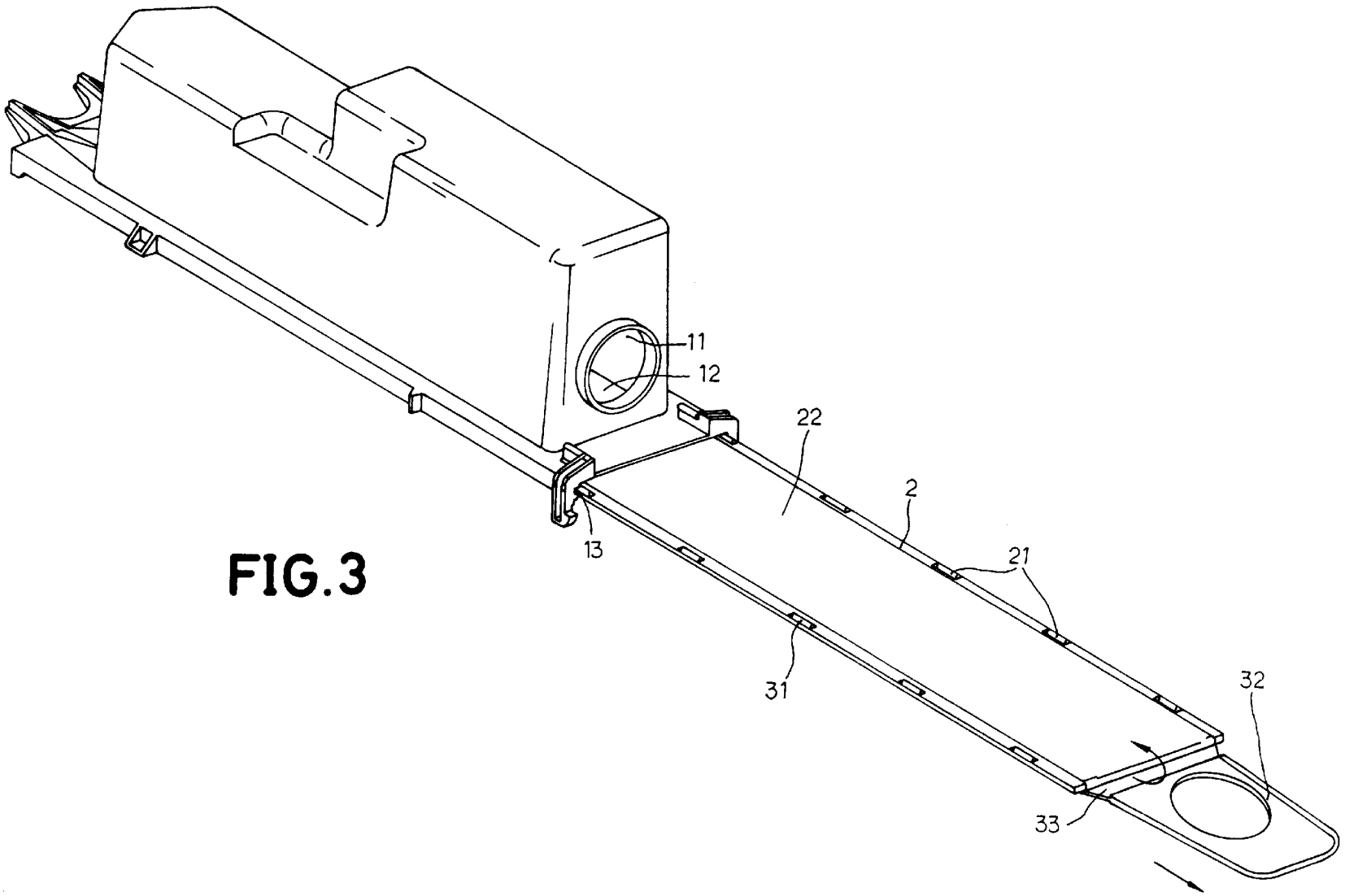
FIG. 3 is a perspective assembly view of the developer container shown in FIG. 2.
Figure 4:
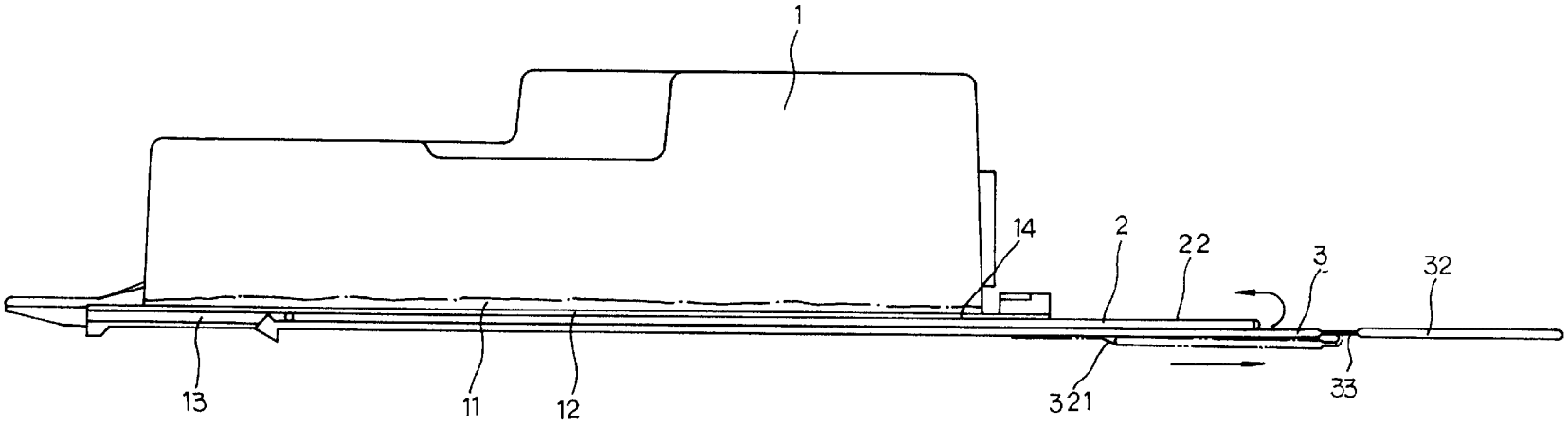
FIG. 4 is a side view in section of the present invention showing the opening procedure of the sliding cover.
Figure 5:
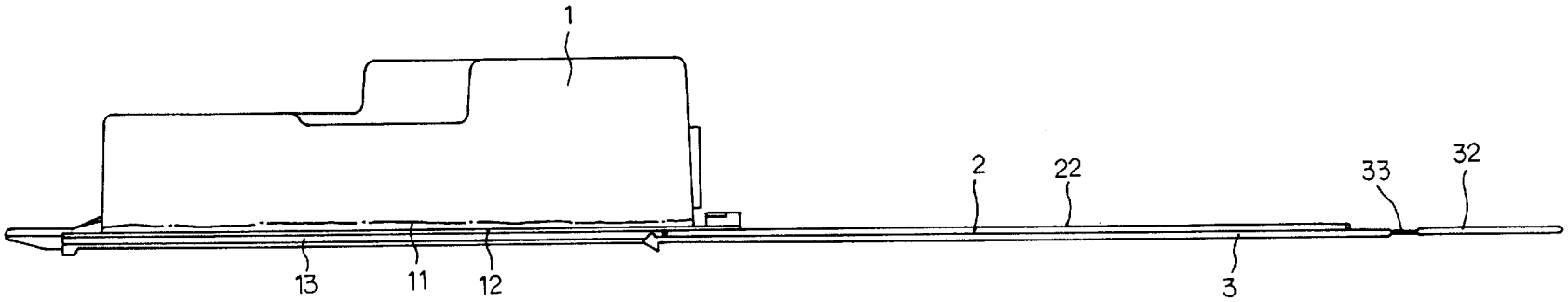
FIG. 5 is similar to FIG. 4 but showing the sliding cover fully opened.

Referring to FIGS. 4 and 5 and FIG. 3 again, when the handhold 32 is pulled outwards with the hand, the sliding cover 2 is moved out of the bottom developer supply hole 12 with the carrier 3, and at the same time the sealing membrane 22 is pulled away from the bottom developer supply hole 12 for enabling contained developer to be supplied out of the developer storage chamber 11.

When the carrier 3 is pushed backwards, the sliding cover 2 is moved with the carrier 3 into the inside of the sliding grooves 13, and the sealing membrane 22 is pushed back to close the bottom developer supply hole 12 again, and then the handhold 32 is folded up and closely attached to the bottom side wall 14 of the carrier 3, and then an adhesive tape 321 is fastened to the handhold 32 and the bottom side wall 14 of the carrier 3 to secure the handhold 32 in the collapsed position (see the dotted line).

While only one embodiment of the present invention has been shown and described, it will be understood that various modifications and changes could be made thereunto without departing from the spirit and scope of the invention disclosed.

What the invention claimed is:

1. A developer container comprising:

a container body, said container body comprising a developer storage chamber, a bottom developer supply hole at a bottom side thereof through which developer is supplied out of said developer storage chamber, and two sliding grooves longitudinally disposed at two opposite sides of said bottom developer supply hole;

a flat, sheet-like carrier moved in and out of the sliding grooves at the bottom side of said container body, said carrier comprising a plurality of hooks symmetrically provided at two opposite lateral sides thereof;

a sliding cover carried on said carrier and moved with said carrier in and out of the sliding grooves at the bottom side of said container body, said sliding cover comprising a plurality of retaining holes symmetrically disposed at two opposite lateral sides thereof and respectively forced into engagement with the hooks at said carrier;

a sealing membrane attached to said sliding cover at a top side and moved with said sliding cover to close and open the bottom developer supply hole of said container body, said sealing membrane having a front end fixedly adhered to the bottom side of said container body at a front side of said bottom developer supply hole, and a rear end fixedly adhered to a part of said sliding cover; and a handhold connected to a front side of said carrier by a hinge, said hinge enables said handhold to fold to a position in which said handhold lies beneath and is parallel to said carrier.

* * * * *